US005609147A

United States Patent [19]

Withorn, Jr.

[11] Patent Number: 5,609,147

[45] Date of Patent: Mar. 11, 1997

[54] ARROW THREAD TRACKING APPARATUS FOR A BOW

[76] Inventor: William C. Withorn, Jr., 5065 Pointview Dr., Harrison, Mich. 48625

[21] Appl. No.: 488,758

[22] Filed: Jun. 8, 1995

[51] Int. Cl.[6] ..... F41B 5/14

[52] U.S. Cl. ..... 124/86; 242/129.7; 242/129.8

[58] Field of Search ..... 124/23.1, 86, 88; 242/129.7, 129.71, 129.8, 593

[56] References Cited

U.S. PATENT DOCUMENTS

| | | | |
|---|---|---|---|
| D. 309,119 | 7/1990 | Kremitzki | D10/104 |
| 1,345,190 | 6/1920 | Hutchinson | 242/129.8 X |
| 2,580,129 | 12/1951 | Rich | 242/129.8 |
| 2,938,514 | 5/1960 | Berg | 124/88 |
| 3,949,730 | 4/1976 | Schoenberger | 124/88 X |
| 4,024,667 | 5/1977 | Wegener | 43/19 |
| 4,050,648 | 9/1977 | Tisma | 242/129.8 |
| 4,073,419 | 2/1978 | Tarrson et al. | 242/129.8 X |
| 4,309,974 | 1/1982 | Carter et al. . | |
| 4,651,999 | 3/1987 | Sturm | 273/416 |
| 4,726,348 | 2/1988 | Saunders | 124/23.1 |
| 4,801,151 | 1/1989 | Sturm et al. | 273/416 |
| 5,143,044 | 9/1992 | Bourquin | 124/88 |

*Primary Examiner*—John A. Ricci

[57] ABSTRACT

An arrow thread tracking apparatus is provided for attachment to a bow and includes a bolt assembly which includes a threaded first bolt end, a middle bolt portion, and a second bolt end which includes a head. The threaded first bolt end is connected to the bow. A thread assembly includes a hollow bolt-receiving portion and a quantity of thread wound around the hollow bolt-receiving portion in a form of a spool of thread. The hollow bolt-receiving portion jackets the middle bolt portion of the bolt assembly. A housing assembly includes a substantially closed first end which includes a bolt-receiving orifice. The housing assembly includes a substantially open second end. The second end receives the bolt assembly, receives the thread assembly, and receives a brake element carried by the middle bolt portion of the bolt assembly adjacent to the bolt head. The brake element is a compressible structure. An offset bracket may be provided between the housing assembly and the bow. The offset bracket includes a connector-receiving orifice located at a first end of the offset bracket, and a bolt-receiving orifice located at a second end of the offset bracket. The bolt-receiving orifice receives the threaded first bolt end of the bolt assembly.

3 Claims, 4 Drawing Sheets

FIG 3
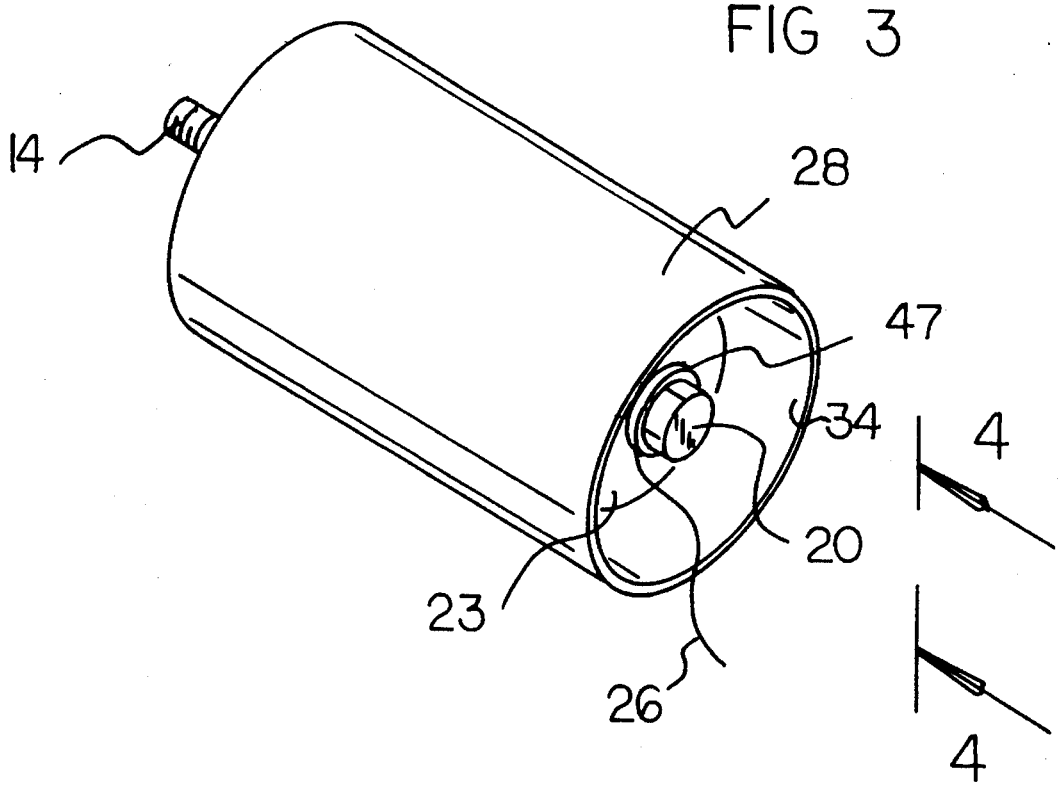
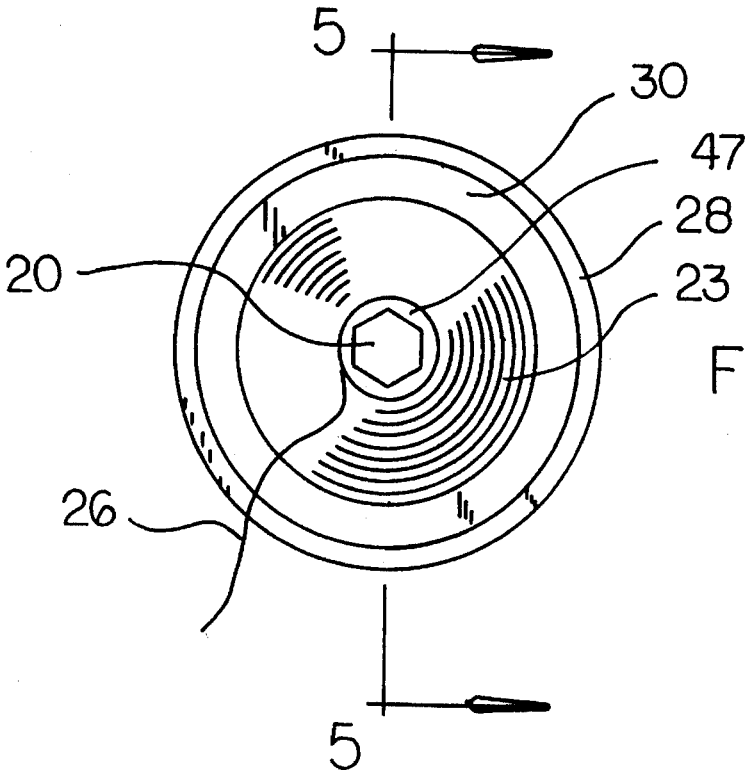
FIG 4

ARROW THREAD TRACKING APPARATUS FOR A BOW

BACKGROUND OF THE INVENTION

1. Field of the Invention

The present invention relates generally to devices used with bows and arrows and, more particularly, to devices especially adapted for using a thread or string for tracking an arrow shot by a bow.

2. Description of the Prior Art

When hunting with a bow and arrow, once an arrow is shot, it may be difficult to locate the shot arrow. This may be so if the arrow lands in rough terrain or if the arrow strikes an animal and the animal runs off for a while before it weakens and falls. Throughout the years, a number of innovations have been developed relating to using thread or swing for tracking arrows shot by bows, and the following U.S. Pat. Nos. are representative of some of those innovations: 4,024,667; 4,309,974; 4,651,999; 4,726,348; and 4,801,151. More specifically, U.S. Pat. No. 4,024,667 discloses a fishing reel and support for archery bows. A fishing reel is a relatively large, heavy, and complex structure. Its large size adds unwanted bulk to an archery bow. Its heavy weight shifts the center of gravity and balance of the archery bow. Its complex structure is provided so that the fishing line can be reeled back into the fishing reel. In this respect, it would be desirable if an apparatus were provided which permitted tracking an arrow without using a relatively large, heavy, and complex structure.

U.S. Pat. No. 4,309,974 discloses a game finder hunting bow combination in which a housing containing a prepackaged string is attached to the side of an archery bow. In this respect, the arrow flies in a first vertical plane, and the string is payed out in a second vertical plane offset to the side of the first vertical plane. By being attached to the side of the bow and by being payed out in a vertical plane that is offset to the side of the vertical plane of the flight of the arrow, as the string is payed out with the arrow in flight, there is a sideways force exerted on the arrow in flight. Such a sideways force may cause the flight path of the arrow to be skewed to the side causing the arrow to miss the target. In this respect, it would be desirable if an apparatus were provided for paying out a prepackaged thread to follow an arrow where the thread was payed out in the same vertical plane as the flight of the arrow. If this were done, there would be no sideways force tending to skew the flight path of the arrow.

U.S. Pat. Nos. 4,651,999 and 4,801,151 disclose arrow string tracking apparatuses in which the arrow itself has a complex structure for accommodating string. Having such complex arrow structures is very expensive and upsets the balance of an arrow. In this respect, it would be desirable if an arrow tracking apparatus were provided which does not have complex string-retaining structures built into the arrows.

U.S. Pat. No. 4,726,348 discloses a string tracking mechanism for a bow and arrow in which two separate and distinct structures are attached to the bow. The string housing is attached to the bow, and a string guidance clip is attached to the bow. To avoid the complexities entailed by having two separate and distinct structures attached to the bow, it would be desirable to provide string tracking device for a bow and arrow which does not employ a string guidance clip attached to the bow.

Still other features would be desirable in an arrow thread tracking apparatus for a bow. For example, a spool containing thread requires a shaft of some sort to rotate around. Moreover, a housing containing a thread needs to be attached to the bow. For purposes of simplicity and economy, it would be desirable if a single structure can serve as both a shaft for the spool and an attachment means for the housing.

Many bows are provided with threaded holes for optional attachment of a riser. In this respect, it would be desirable if an arrow thread tracking apparatus could be attached to a bow using the threaded riser hole. Use of the threaded riser hole on a bow for attachment of an arrow thread tracking apparatus would readily permit retrofitting of many bows with arrow thread tracking apparatuses.

With some bows, an attachment of an arrow thread tracking apparatus to the threaded riser hole would pose no problem. However, there are some bows in which the direct attachment of an arrow thread tracking apparatus to a threaded riser hole would pose a problem. The problem would be that insufficient clearance would be provided for a user's hand when holding the bow. In such an instance, it would be desirable if a special bracket could be used to attach the arrow thread tracking apparatus to the bow using the threaded riser hole on the bow. Such a special bracket would provide the necessary clearance for the user's hand when holding the bow.

Thus, while the foregoing body of prior art indicates it to be well known to use bow and arrow string tracking apparatuses, the prior art described above does not teach or suggest an arrow thread tracking apparatus for a bow which has the following combination of desirable features: (1) permits tracking an arrow without using a relatively large, heavy, and complex structure; (2) provides for paying out a prepackaged thread to follow an arrow where the thread is payed out in the same vertical plane as the flight of the arrow; (3) does not have complex string-retaining structures built into the arrows; (4) does not employ a string guidance clip attached to the bow; (5) provides a single structure that serves as both a shaft for the spool and an attachment means for the housing; (6) can be attached to a bow using the threaded riser hole present in the bow; (7) permits retrofitting of many bows with arrow thread tracking apparatuses; and (8) provides a special bracket that can be used to attach the arrow thread tracking apparatus to the bow using the threaded riser hole on the bow. The foregoing desired characteristics are provided by the unique arrow thread tracking apparatus for a bow of the present invention as will be made apparent from the following description thereof. Other advantages of the present invention over the prior art also will be rendered evident.

SUMMARY OF THE INVENTION

To achieve the foregoing and other advantages, the present invention, briefly described, provides an arrow thread tracking apparatus for attachment to a bow and includes a bolt assembly which includes a threaded first bolt end, a middle bolt portion, and a second bolt end which includes a head. The threaded first bolt end is adapted to be is connected to the bow. A thread assembly includes a hollow bolt-receiving portion and a quantity of thread wound around the hollow bolt-receiving portion in a form of a spool of thread. The hollow bolt-receiving portion jackets the middle bolt portion of the bolt assembly. A housing assembly includes a substantially closed first end which includes a bolt-receiving orifice. The housing assembly includes a substantially open second end. The second end receives the bolt assembly, receives the thread assembly, and receives a brake element carried by the middle bolt portion of the bolt assembly adjacent to the bolt head.

The brake element is a compressible structure. By selectively varying a distance between a top of the bolt head and the bow, a braking pressure can be selectively applied to the brake element for preventing rotation of the thread assembly around the middle bolt portion of the bolt assembly; or a braking pressure can be selectively released from the brake element for permitting the thread assembly to rotate around the middle bolt portion of the bolt assembly. Also, the brake element is used as a thread holder (when the unit is not in use) by wrapping the thread around the brake element and pulling tight.

An offset bracket is located between the housing assembly and the bow. The offset bracket includes a connector-receiving orifice located at a first end the offset backet, and a bolt-receiving orifice locatd at a second end of the offset bracket. The bolt-receiving orifice receives the threaded first bolt end of the bolt assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved arrow thread tracking apparatus for a bow which has all of the advantages of the prior art and none of the disadvantages.

It is another object of the present invention to provide a new and improved arrow thread tracking apparatus for a bow which may be easily and efficiently manufactured and marketed.

It is a further object of the present invention to provide a new and improved arrow thread tracking apparatus for a bow which is of durable and reliable construction.

An even further object of the present invention is to provide a new and improved arrow thread tracking apparatus for a bow which is susceptible of a low cost of manufacture with regard to both materials and labor, and which accordingly is then susceptible of low prices of sale to the consuming public, thereby making such arrow thread tracking apparatus for a bow available to the buying public.

Still yet a further object of the present invention is to provide a new and improved arrow thread tracking apparatus for a bow which permits tracking an arrow without using a relatively large, heavy, and complex structure.

Still another object of the present invention is to provide a new and improved arrow thread tracking apparatus for a bow that provides for paying out a prepackaged thread to follow an arrow where the thread is payed out in the same vertical plane as the flight of the arrow.

Yet another object of the present invention is to provide a new and improved arrow thread tracking apparatus for a bow which does not have complex string-retaining structures built into the arrows.

Even another object of the present invention is to provide a new and improved arrow thread tracking apparatus for a bow that does not employ a string guidance clip attached to the bow.

Still a further object of the present invention is to provide a new and improved arrow thread tracking apparatus for a bow which provides a single structure that serves as both a shaft for the spool and an attachment means for the housing.

Yet another object of the present invention is to provide a new and improved arrow thread tracking apparatus for a bow that can be attached to a bow using the threaded riser hole present in the bow.

Still another object of the present invention is to provide a new and improved arrow thread tracking apparatus for a bow which permit retrofitting of many bows with arrow thread tracking apparatus for a bows.

Yet another object of the present invention is to provide a new and improved arrow thread tracking apparatus for a bow that provides a special bracket that can be used to attach the arrow thread tracking apparatus for a bow to the bow using the threaded riser hole on the bow.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is an enlarged perspective view of the embodiment of the arrow thread tracking apparatus for a bow of FIG. 1 removed from the bow.

FIG. 4 is an enlarged front view of the embodiment of the invention shown in FIG. 3 taken along lines 4—4 in FIG. 3.

DESCRIPTION OF THE PREFERRED EMBODIMENT

With reference to the drawings, a new and improved arrow thread tracking apparatus for a bow embodying the principles and concepts of the present invention will be described.

Figure 7:
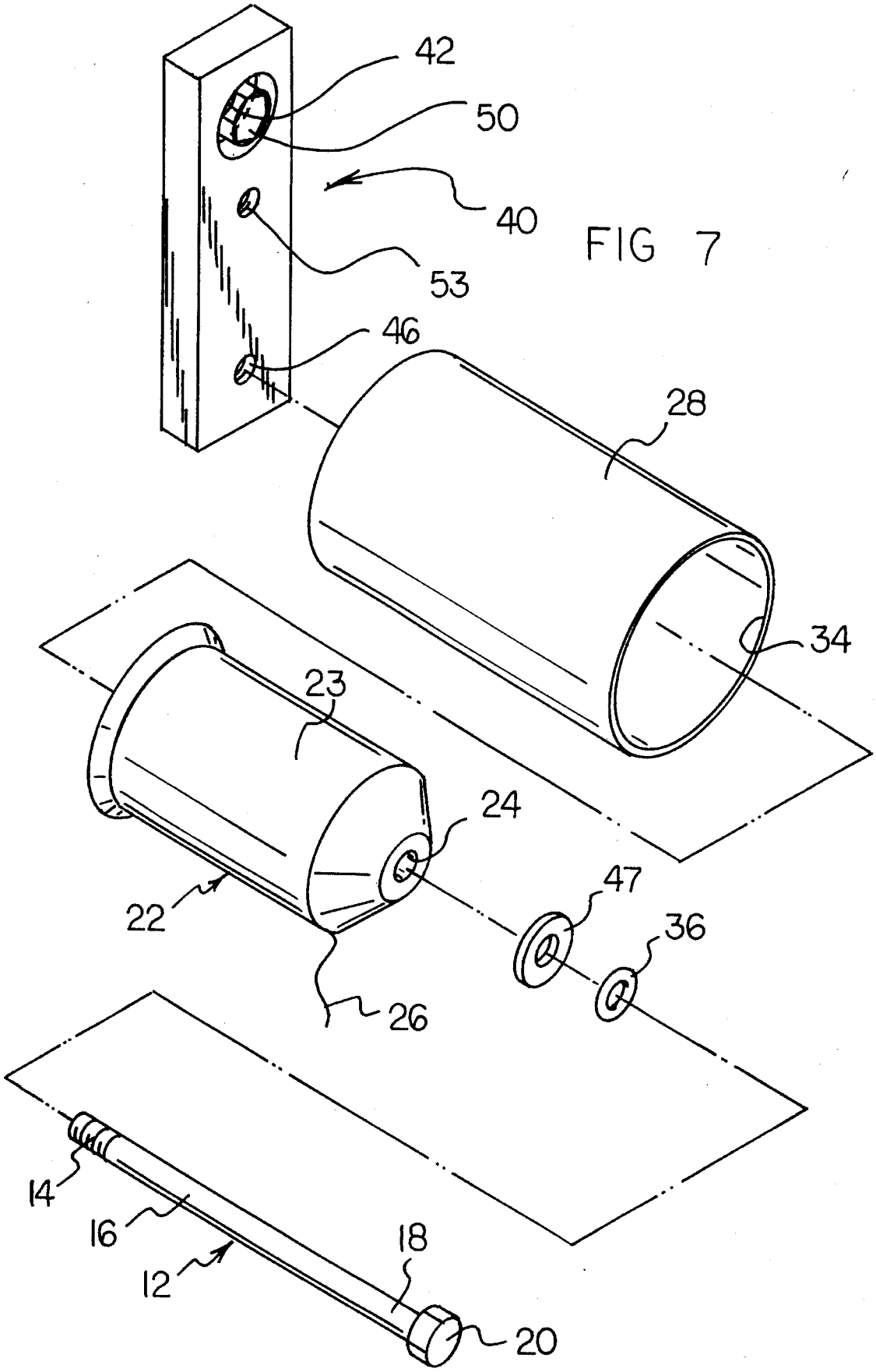
FIG. 7 is an exploded perspective view of the second embodiment of the invention shown in FIG. 6 removed from the bow; moreover, FIG. 7 also shows the elements of the first embodiment of the invention in exploded fashion.

Turning to FIGS. 1–5 and most of FIG. 7, there is shown a first embodiment of the arrow thread tracking apparatus for a bow of the invention generally designated by reference numeral 10. In its preferred form, arrow thread tracking apparatus for a bow 10 includes a bolt assembly 12 which includes a threaded first bolt end 14, a middle bolt portion 16, and a second bolt end 18 which includes a head 20. The threaded first bolt end 14 is adapted to be is connected to the bow 35. A thread assembly 22 includes a hollow bolt-receiving portion 24 and a quantity of thread 26 wound around the hollow bolt-receiving portion 24 in a form of a spool 23 of thread. The hollow bolt-receiving portion 24 jackets the middle bolt portion 16 of the bolt assembly 12. A housing assembly 28 includes a substantially closed first end 30 which includes a bolt-receiving orifice 32. The housing assembly 28 includes a substantially open second end 34. The second end 34 receives the bolt assembly 12, receives the thread assembly 22, and receives a brake element 36 carried by the middle bolt portion 16 of the bolt assembly 12 adjacent to the bolt head 20.

The brake element 36 is a compressible structure. By selectively varying a distance 51 between a top of the bolt head 20 and the bow 35, a braking pressure can be selectively applied to the brake element 36 for preventing rotation of the thread assembly 22 around the middle bolt portion 16 of the bolt assembly 12; or a braking pressure can be selectively released from the brake element 36 for permitting the thread assembly 22 to rotate around the middle bolt portion 16 of the bolt assembly 12. Also, the thread can be wrapped around the brake element 36 and pulled tight; the brake element acts as a thread holder when the unit is not in use.

In using the arrow thread tracking apparatus 10 of the invention shown in FIGS. 1–5 and 7, a thread assembly 22 is placed over a bolt assembly 12 by moving the thread assembly 22 longitudinally along the bolt assembly 12 so that the threaded first bolt and 14 passes through the hollow bolt-receiving portion 24 of the thread assembly 22. Thereby, the hollow bolt-receiving portion 24 of the thread assembly 22 jackets the middle bolt portion 16 of the bolt assembly 12. The threaded first bolt end 14 of the bolt assembly 12 extends out from the hollow bolt-receiving portion 24 and is passed through the bolt-receiving orifice 32 of the first end 30 of the housing assembly 28. The threaded first bolt end 14 of the bolt assembly 12 is screwed into a complementarily threaded riser hole 33 on a bow 35. The bolt head 20 is turned so that the threaded first bolt end 14 enters the riser hole 33 of the bow 35 to support the arrow thread tracking apparatus 10 of the invention on the bow 35.

The amount of penetration of the bolt assembly 12 into the bow 35 is selectively varied so that the bolt head 20 does not impede rotation of the thread assembly 22 around the middle bolt portion 16 of the bolt assembly 12. Clearly, the distance 51 between the top of the bolt head 20 and the bow 35 can be varied to some degree. When the bolt head 20 is relatively close to the bow 35, the bolt head 20 presses against the brake element 36 thereby preventing the thread assembly 22 from rotating around the middle bolt portion 16 of the bolt assembly 12. On the other hand, when the bolt assembly 12 is partially unscrewed from the bow 35, then the distance 51 is increased thereby removing pressure off of the brake element 36 by the bolt head 20 and permitting the thread assembly 22 to rotate freely around the middle bolt portion 16 of the bolt assembly 12.

A free end 25 of the thread 26 is pulled off of the spool 23 and is connected to an arrow assembly 37. More specifically, the arrow assembly 37 includes an arrow shaft portion 39 and a broadhead portion 41 attached to the arrow shaft portion 39. The free end 25 of the thread 26 is wrapped around a threaded portion 43 of the broadhead portion 41. Then, the thread-wrapped threaded portion 43 of the broadhead portion 41 is screwed into a complementarily threaded receiving portion 45 in the arrow shaft portion 39. In this way, the thread 26 is fixed to the arrow assembly 37. When the arrow assembly 37 is shot from the bow 35 in the normal way, the thread 26 is payed out from the thread assembly 22. As the arrow assembly 37 flies through the air and as the thread 26 is unspooled from the thread assembly 22, the thread assembly 22 rotates around the middle bolt portion 16 of the bolt assembly 12. After the arrow assembly 37 hits a target, the arrow assembly 37 and the target can be found by following the thread 26 that was payed out during the flight of the arrow assembly 37.

Figure 1:
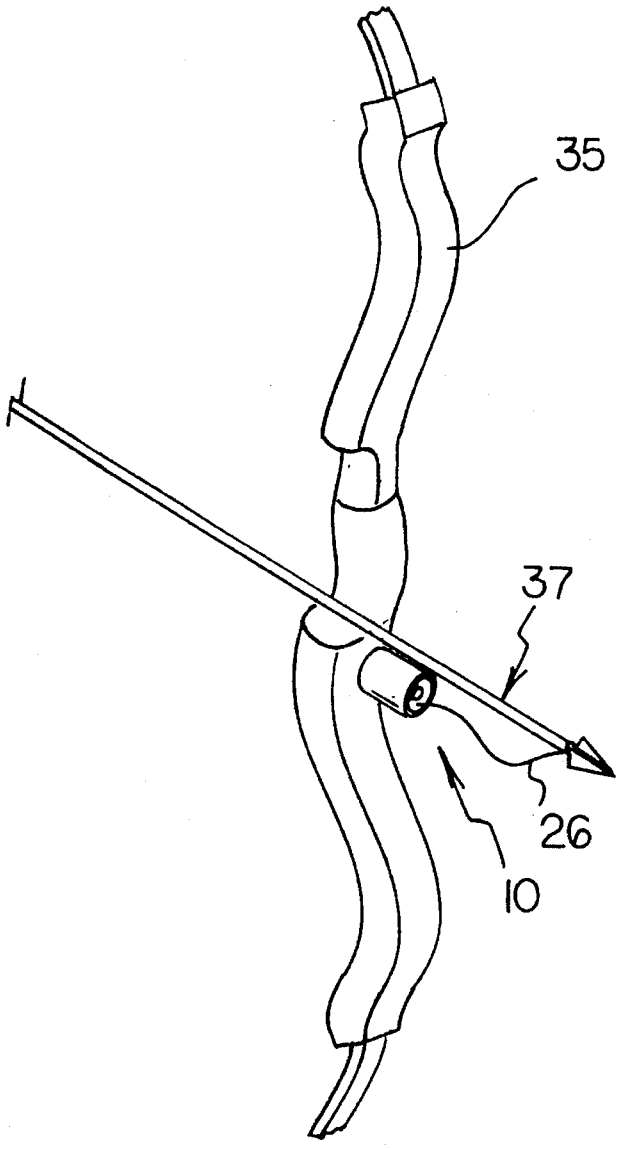
FIG. 1 is a perspective view showing a first embodiment of the arrow thread tracking apparatus for a bow of the invention attached to a bow.
Figure 2:
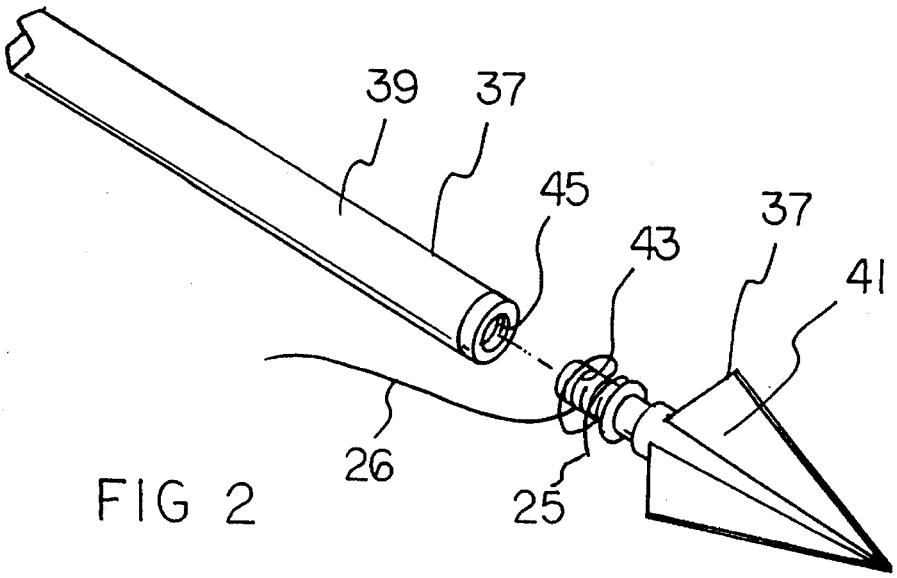
FIG. 2 is an enlarged, partially exploded, perspective view of the embodiment of the arrow thread tracking apparatus for a bow shown in FIG. 1 illustrating how one end of a thread is attached to an arrow.
Figure 5:
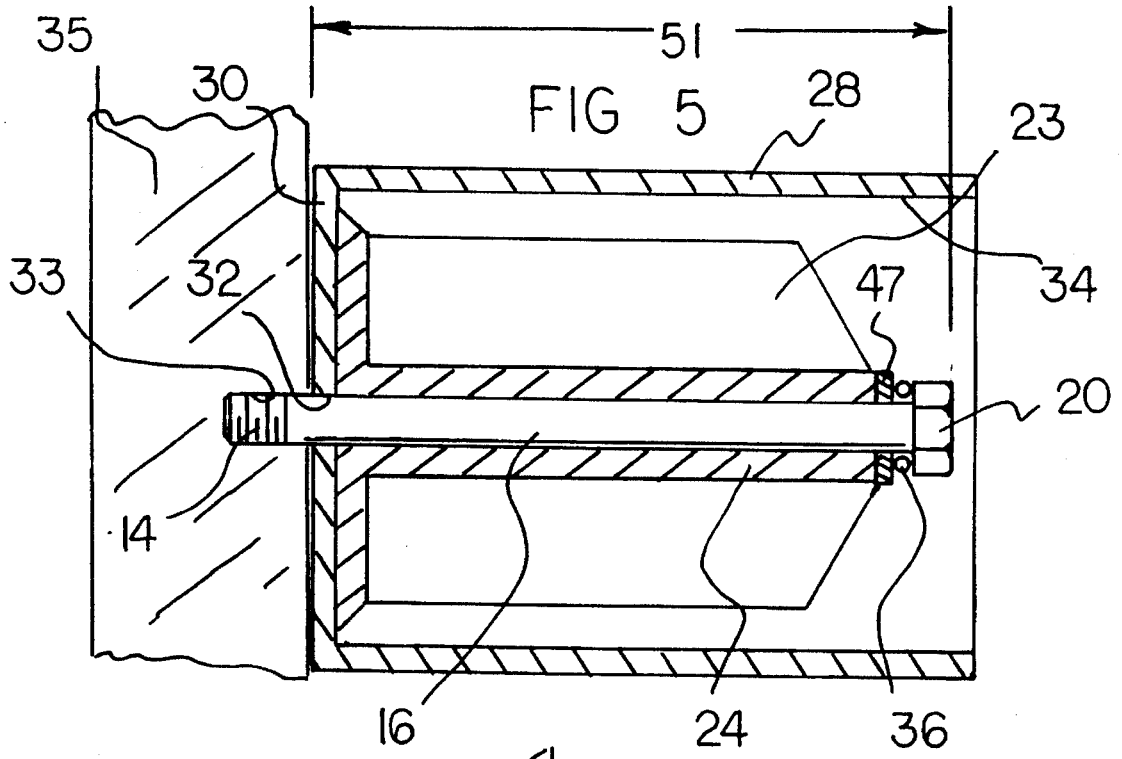
FIG. 5 is an enlarged cross-sectional view of the embodiment of the invention shown in FIG. 4 taken along line 5—5 of FIG. 4.

When the arrow thread tracking apparatus 10 is not in use, the thread assembly 22 should be prevented from rotating around the middle bolt portion 16 of the bolt assembly 12. To do this, the bolt assembly 12 is rotated so that the threaded first bolt end 14 of the bolt assembly 12 penetrates further into the riser hole 33 in the bow 35. As this turning proceeds, the bolt head 20 presses against the brake element 36, which is a compressible rubber O-ring 36, between the bolt head 20 and the thread assembly 22. Such pressure against the brake element 36 prevents the thread assembly 22 from rotating around the middle bolt portion 16 of the bolt assembly 12. As shown in FIG. 5. A washer 47 can be placed between the brake element 36 and the thread assembly 22 on the bolt assembly 12.

Figure 6:
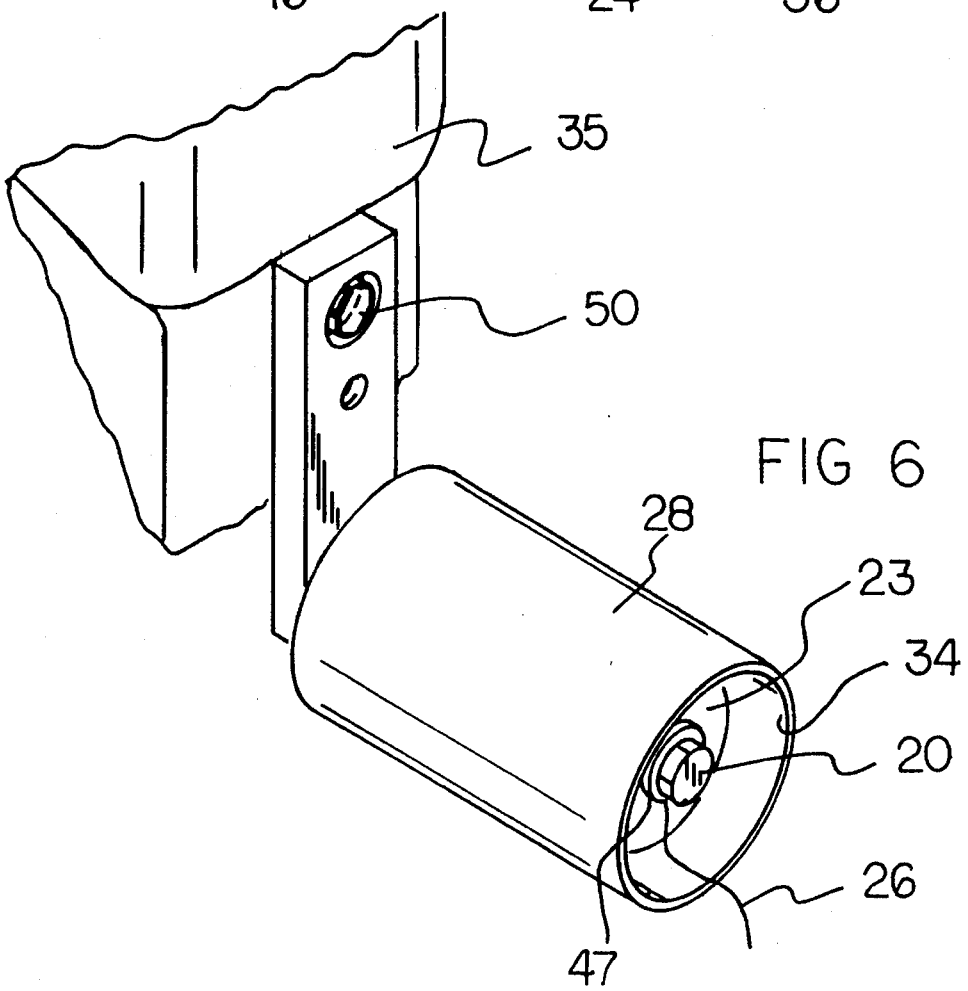
FIG. 6 is a perspective view of a second embodiment of the invention attached to a bow.

Turning to FIGS. 6–7, a second embodiment of the invention is shown. Reference numerals are shown that correspond to like reference numerals that designate like elements shown in the other figures. In addition, an offset bracket 40 is located between the housing assembly 28 and the bow 35. The offset bracket 40 includes a connector-receiving orifice 42 located at a first end 44 of the offset bracket 40, and a bolt-receiving orifice 46 located at a second end 48 of the offset bracket 40. The bolt-receiving orifice 46 receives the threaded first bolt end 14 of the bolt assembly 12.

In using the second embodiment of the invention, the shaft of a connector, such as the shaft of a bolt 50 is inserted through the connector-receiving orifice 42 of the offset bracket 40 and is screwed into the riser hole 33 of the bow 35. Then, the threaded first bolt end 14 of the bolt assembly 12 is screwed into the bolt-receiving orifice 46 of the offset bracket 40. In this way, the arrow thread tracking apparatus 10 of the invention is connected to the bow 35 in a manner that is offset from the riser hole 33 of the bow 35. A second bolt-receiving orifice 53 can be provided at a different distance from the connector-receiving orifice 42 to enable selection of an alternative offset of the thread assembly 22 of the arrow thread tracking apparatus 10 of the invention from the riser hole 33.

For bows 35 which do not include a riser hole 33, a threaded hole can be made in the bow 35. Alternatively, a channel can be drilled through the bow 35, and nuts can be used at the threaded first bolt end 14 of the bolt assembly 12 for securing the bolt assembly 12 to the bow 35.

The components of the arrow thread tracking apparatus for a bow of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved arrow thread tracking apparatus for a bow that is low in cost, relatively simple in design and operation, and which may advantageously be used to permit tracking an arrow without using a relatively large, heavy, and complex structure. With the invention, an arrow thread tracking apparatus for a bow provides for paying out a prepackaged thread to follow an arrow where the thread is payed out in the same vertical plane as the flight of the arrow. With the invention, an arrow thread tracking apparatus for a bow is provided which does not have complex string-retaining structures built into the arrows. With the invention, an arrow thread tracking apparatus for a bow is provided which does not employ a string guidance clip attached to the bow. With the invention, an arrow thread tracking apparatus for a bow provides a single structure that serves as both a shaft for the spool and an attachment means for the housing. With the invention, an arrow thread tracking apparatus for a bow is provided which can be attached to the bow using the threaded riser hole present in the bow. With the invention, an arrow thread tracking apparatus for a bow is provided which permits retrofitting of many bows with arrow thread tracking apparatuses. With the invention, an arrow thread tracking apparatus for a bow provides a special bracket that can be used to attach the arrow thread tracking apparatus to the bow using the threaded riser hole on the bow.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. An arrow thread tracking apparatus for attachment to a bow, comprising:

a bolt assembly which includes a threaded first bolt end, a middle bolt portion, and a second bolt end which includes a head, wherein said threaded first bolt end is adapted to be connected to the bow, a thread assembly which includes a hollow bolt-receiving portion and a quantity of thread wound around said hollow bolt-receiving portion in a form of a spool of thread, wherein said hollow bolt-receiving portion jackets said middle bolt portion of said bolt assembly, a housing assembly which includes a substantially closed first end which includes a bolt-receiving orifice, wherein said housing assembly includes a substantially open second end, wherein said second end receives said bolt assembly and said thread assembly, and a brake element carried by said middle bolt portion of said bolt assembly adjacent to said bolt head, further including:

an offset bracket located between said housing assembly and the bow, and wherein said offset bracket includes:

a connector-receiving orifice located at a first end of said offset bracket, and a bolt-receiving orifice located at a second end of said offset bracket, wherein said bolt-receiving orifice receives said threaded first bolt end of said bolt assembly.

2. The apparatus of claim 1 wherein said brake element is a compressible structure.

3. The apparatus of claim 1 wherein, by selectively varying a distance between a top of said bolt head and the bow, a braking pressure can be selectively applied to said brake element for preventing rotation of said thread assembly around said middle bolt portion of said bolt assembly, or a braking pressure can be selectively released from said brake element for permitting said thread assembly to rotate around said middle bolt portion of said bolt assembly.

* * * * *